United States Patent [19]

Peters

[11] Patent Number: 5,062,463

[45] **Date of Patent: * Nov. 5, 1991**

[54] WINDOW CORNICE AND METHOD FOR HANGING CURTAINS

[76] Inventor: Margaret A. Peters, 1139 Summit Lawn, Wichita, Kans. 67212

[ * ] Notice: The portion of the term of this patent subsequent to Sep. 12, 2006 has been disclaimed.

[21] Appl. No.: 563,485

[22] Filed: Aug. 6, 1990

Related U.S. Application Data

[63] Continuation of Ser. No. 426,640, Oct. 30, 1989, Pat. No. 4,966,218, which is a continuation of Ser. No. 173,056, Mar. 25, 1988, Pat. No. 4,922,600.

[51] Int. Cl.[5] ..... E04F 10/00

[52] U.S. Cl. ..... 160/38; 160/387

[58] Field of Search ..... 160/38, 39, 19, 330, 160/387, 383; 211/105.1; 29/433

[56] References Cited

U.S. PATENT DOCUMENTS

| | | | |
|---|---|---|---|
| D. 114,564 | 5/1939 | Stratton . | |
| 823,259 | 6/1906 | Burns | 211/105.2 |
| 888,697 | 5/1908 | Cook | 211/87 |
| 1,003,614 | 9/1911 | Kirsch | 211/87 |
| 1,056,325 | 3/1913 | Dahlberg | 211/105.2 |
| 1,154,775 | 9/1915 | Johnson | 150/32 |
| 1,361,058 | 12/1920 | Hills | 211/105.2 |
| 1,465,821 | 8/1923 | Henderson | 160/20 |
| 1,565,734 | 12/1925 | Greenhut | 160/19 X |
| 1,636,601 | 7/1927 | Givens | 160/25 |
| 1,773,590 | 8/1930 | Mathias | 160/19 |
| 1,798,584 | 6/1932 | Blakely | 248/263 |
| 1,914,027 | 6/1933 | Kress | 160/19 |
| 1,963,404 | 6/1934 | Dixson | 160/31 |
| 1,974,645 | 9/1934 | Dixson | 160/31 |
| 2,066,824 | 1/1937 | Cohen | 248/262 |
| 2,138,564 | 10/1938 | Barrow | 160/31 |
| 2,162,674 | 6/1939 | Kenney | 248/262 |
| 2,206,514 | 7/1940 | Rust | 248/262 |
| 2,243,222 | 5/1941 | Rebholz | 156/13 |
| 2,250,003 | 7/1941 | Boye | 160/21 |
| 2,293,662 | 8/1942 | Richardson | 156/13 |
| 2,315,033 | 3/1943 | Adair | 160/39 |
| 2,332,207 | 10/1943 | Derman | 248/262 |
| 2,363,847 | 11/1944 | Dudas | 160/387 |
| 2,513,628 | 7/1950 | Eaglin | 160/39 |
| 2,533,216 | 12/1950 | Bixer | 160/387 |
| 2,563,734 | 8/1951 | Metz et al. | 160/39 X |
| 2,594,656 | 4/1952 | Junkunc | 160/38 |
| 2,604,155 | 7/1952 | Junkunc | 160/38 |
| 2,616,495 | 11/1952 | Junkunc | 160/38 |
| 2,651,357 | 9/1953 | Skwark | 160/34 |
| 2,681,697 | 6/1954 | Mandella | 160/19 |
| 2,708,711 | 5/1955 | McGinty et al. | 248/265 |
| 2,739,644 | 3/1956 | Brand | 160/39 |

(List continued on next page.)

FOREIGN PATENT DOCUMENTS

| | | | |
|---|---|---|---|
| 85641 | 6/1958 | Denmark | 160/39 |
| 260814 | 7/1912 | Fed. Rep. of Germany . | |
| 342061 | 10/1921 | Fed. Rep. of Germany | 160/19 |
| 512168 | 10/1929 | Fed. Rep. of Germany | 34/3 |
| 910439 | 6/1946 | France | 160/38 |
| 1255291 | 1/1961 | France | 160/19 |
| 1529593 | 5/1968 | France | 160/39 |
| 2397177 | 3/1979 | France | 160/39 |
| 163818 | 7/1958 | Sweden . | |

OTHER PUBLICATIONS

Sears Roebuck and Co. Catalog, TM 1981, Diane Von Furstenberg.

*Primary Examiner*—Blair M. Johnson
*Attorney, Agent, or Firm*—John Wade Carpenter

[57] ABSTRACT

A window cornice assembly having a semi-circular front plate formed with an upper edge having an upper channel and a lower edge having a lower channel. A lower curtain rod is slidably disposed through the lower channel and an upper curtain rod is slidably disposed through the upper channel. A method for hanging curtains by sliding a fabric over the window cornice assembly, mounting the upper and lower curtain rods to a wall, and securing a middle curtain rod to the wall in between the upper and lower curtain rods. A curtain is hung from the middle curtain rod.

99 Claims, 4 Drawing Sheets

U.S. PATENT DOCUMENTS

| | | | |
|---|---|---|---|
| 2,823,743 | 2/1958 | Isaac | 160/39 |
| 2,837,150 | 6/1958 | Toti | 160/38 |
| 2,862,549 | 12/1958 | Robbins | 160/38 |
| 2,998,062 | 8/1961 | Bixby | 160/39 |
| 3,023,909 | 3/1962 | Martens | 160/39 X |
| 3,030,060 | 4/1962 | Breuer | 248/265 |
| 3,111,162 | 11/1963 | Bierlich | 160/38 X |
| 3,166,286 | 1/1965 | Pfaff | 248/263 |
| 3,312,273 | 4/1967 | Adam et al. | 160/345 |
| 3,378,057 | 4/1968 | Synck | 160/39 |
| 3,513,902 | 5/1970 | Merillet | 29/433 X |
| 3,881,218 | 5/1975 | Palmer | 16/93D |
| 3,913,204 | 10/1975 | Finkbeiner | 29/433 X |
| 4,179,091 | 12/1979 | Bidney | 248/265 |
| 4,352,433 | 10/1982 | Ford | 211/105.1 |
| 4,363,459 | 12/1982 | Holzer | 248/265 |
| 4,399,917 | 8/1983 | Ohman | 211/87 |
| 4,635,889 | 1/1987 | Bell et al. | 248/265 |
| 4,782,554 | 8/1988 | Lawson | 16/87.4 R |
| 4,824,062 | 4/1989 | Wagner | 248/265 |

FIG. 1
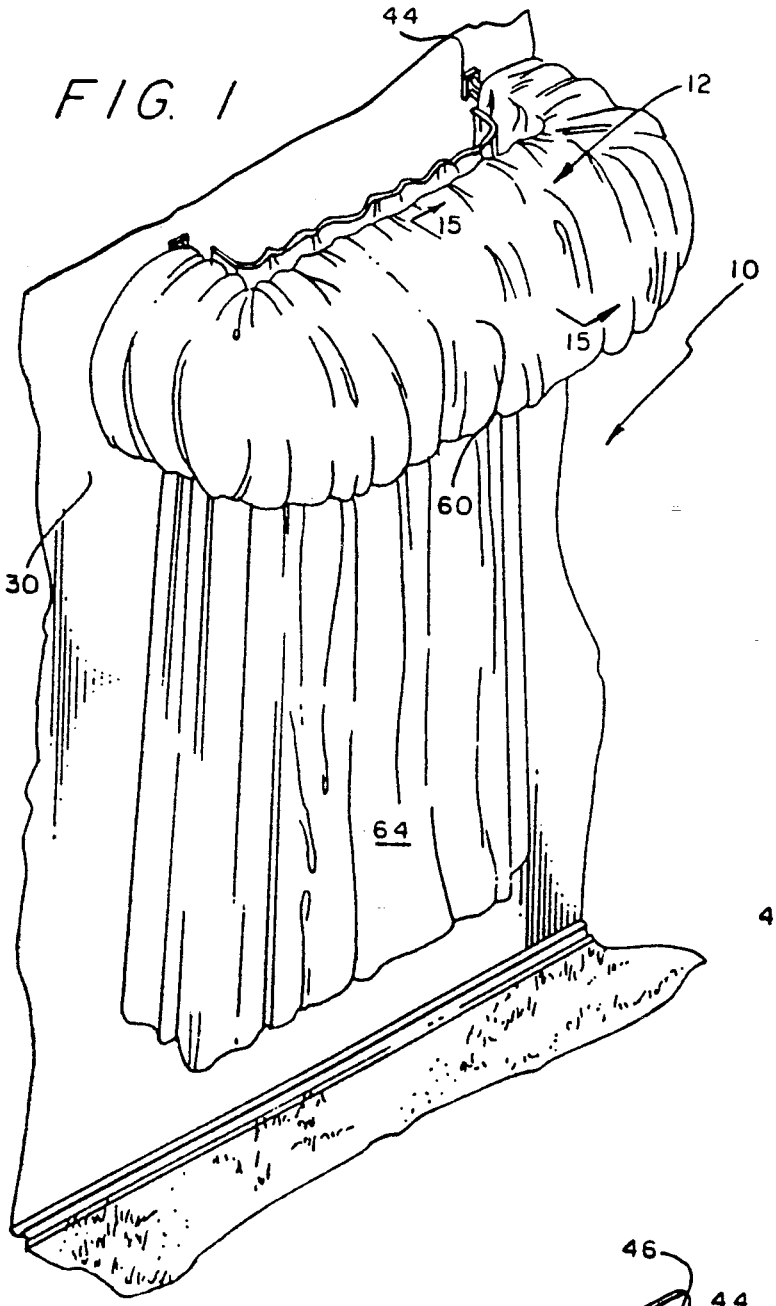
FIG. 2
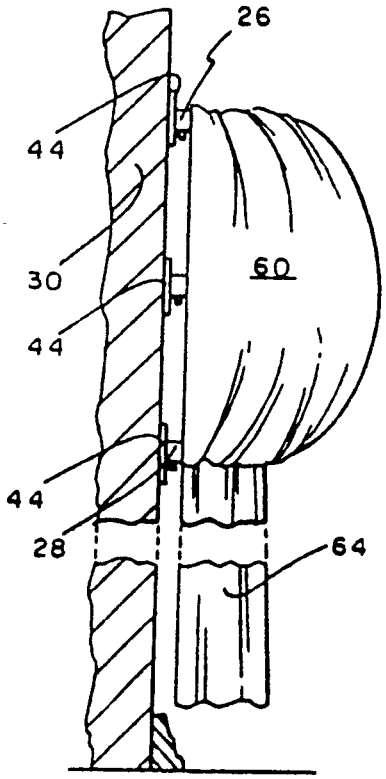
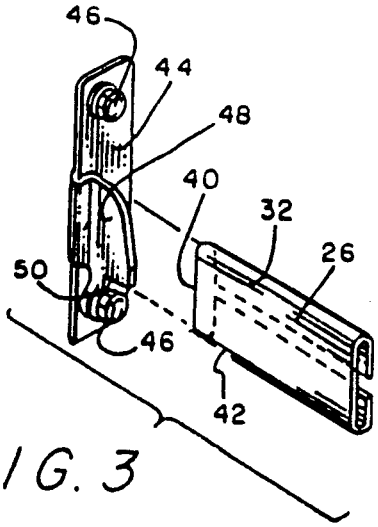
FIG. 3

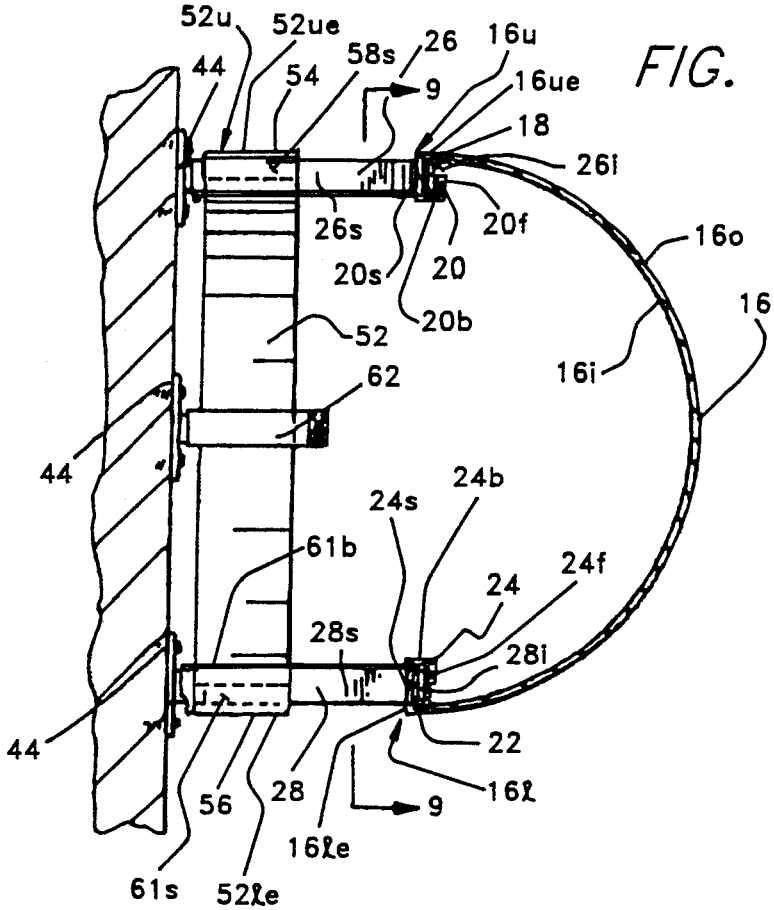
FIG. 5
FIG. 6
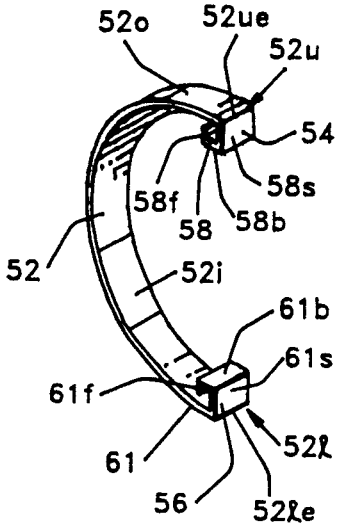
FIG. 4
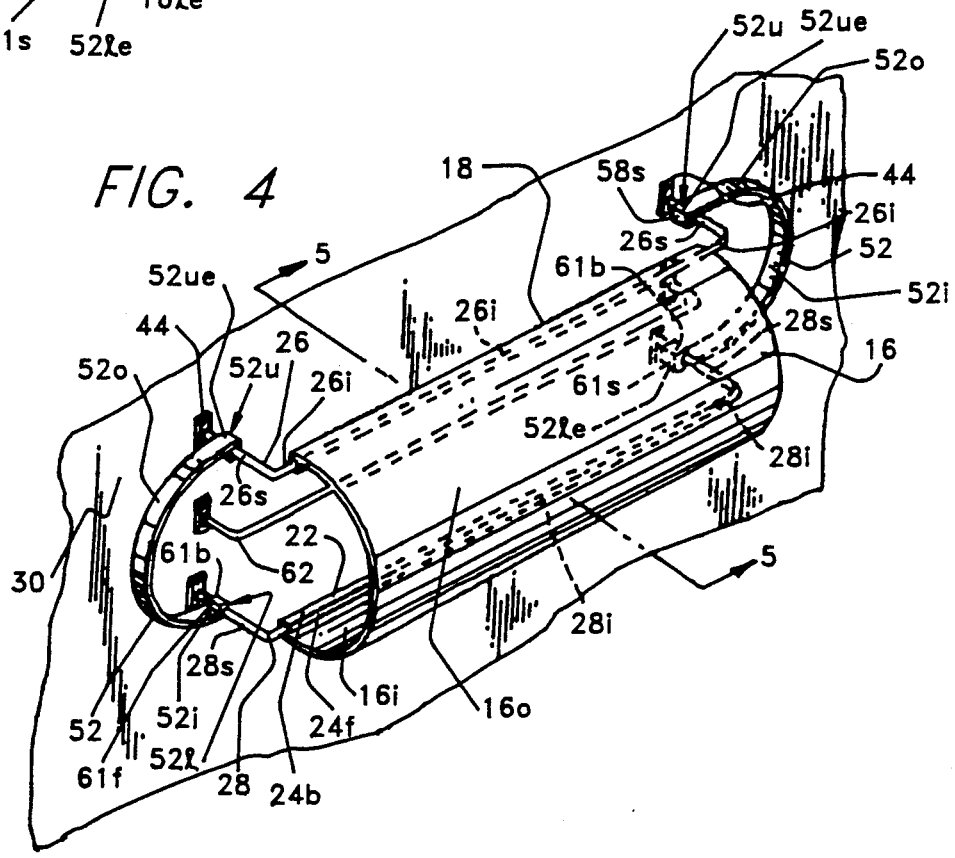

FIG. 7
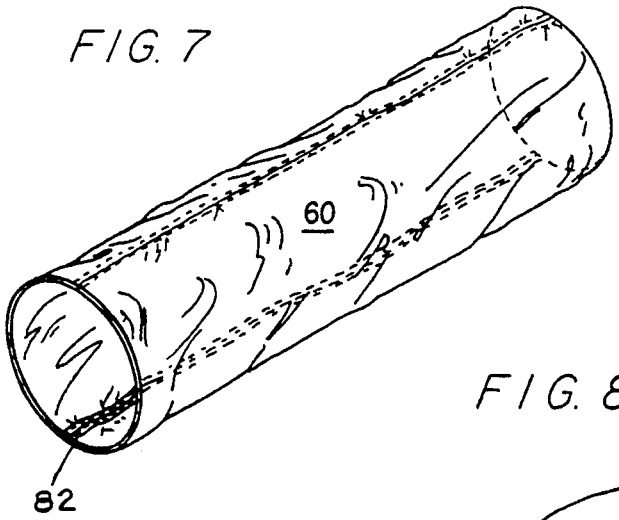
FIG. 8
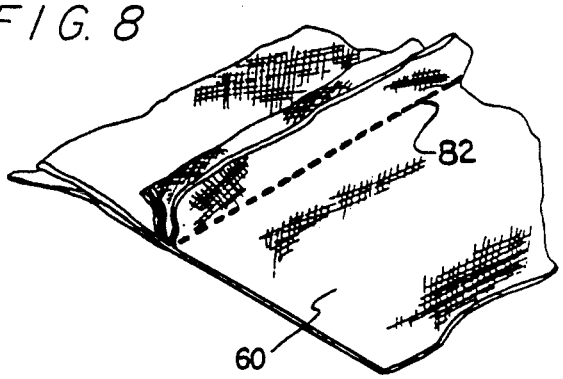
FIG. 9
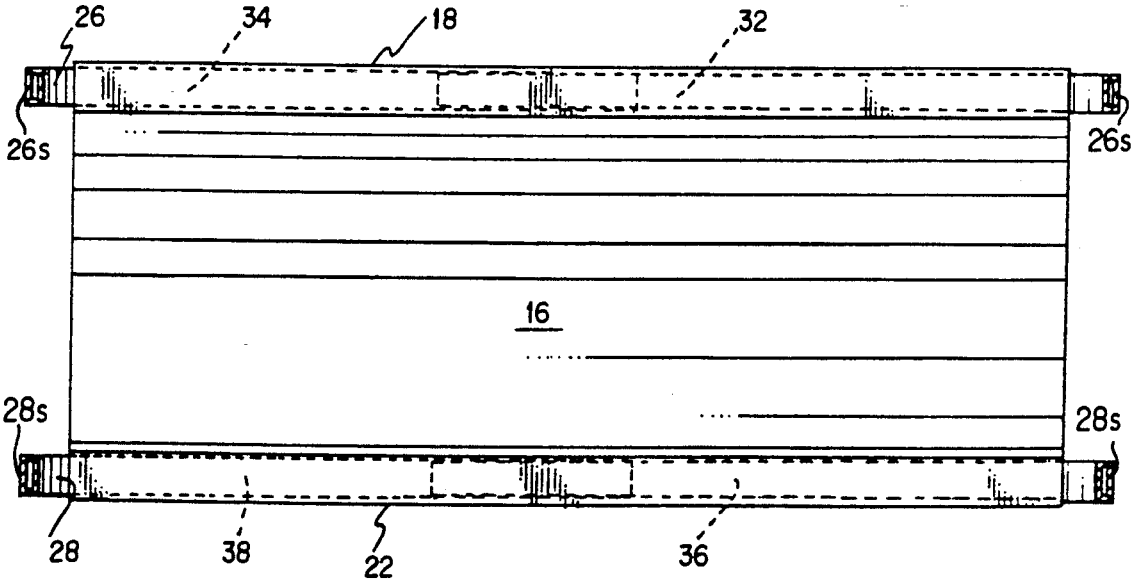
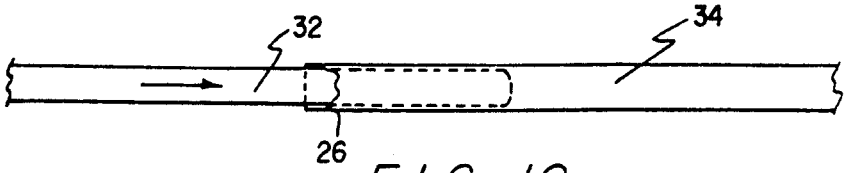
FIG. 10

FIG. 14
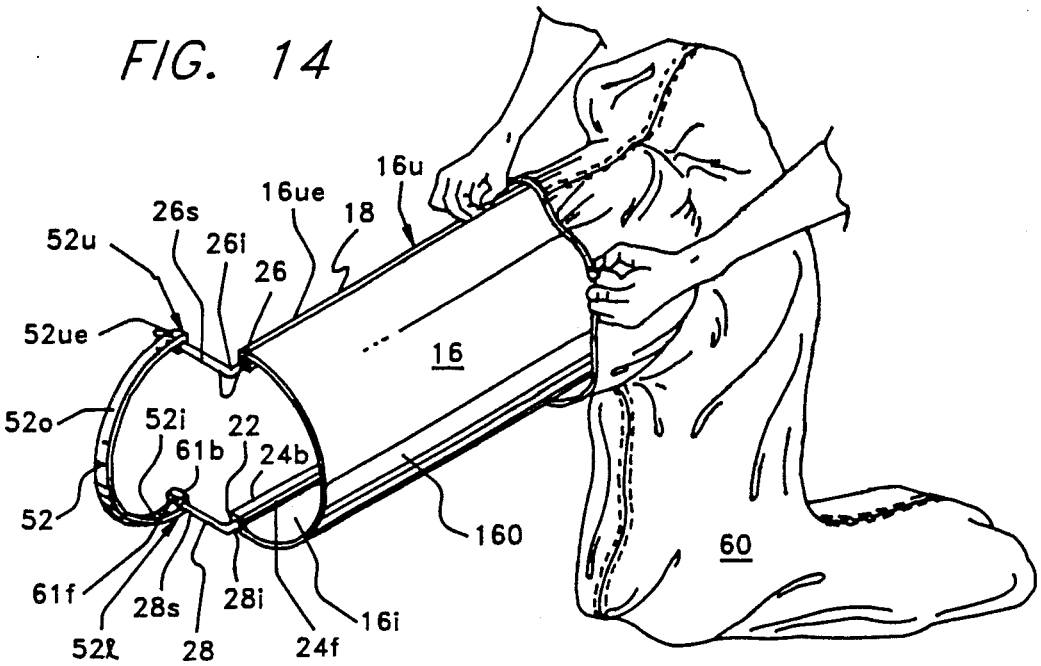
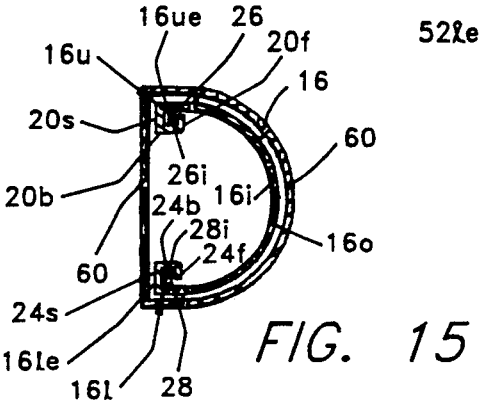
FIG. 15
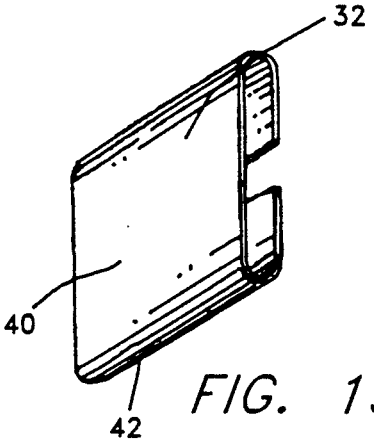
FIG. 13
FIG. 11
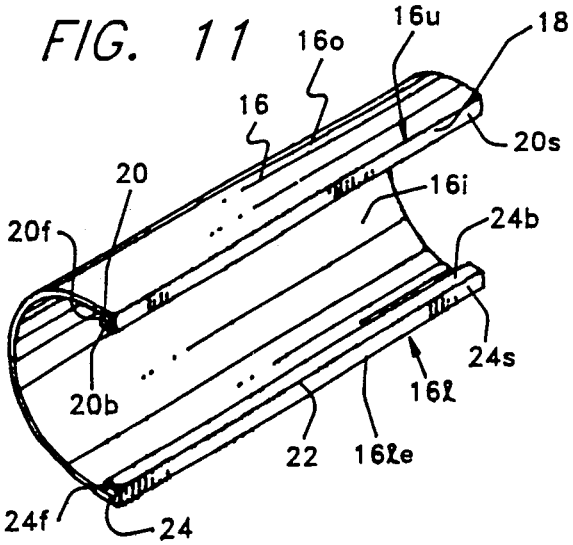
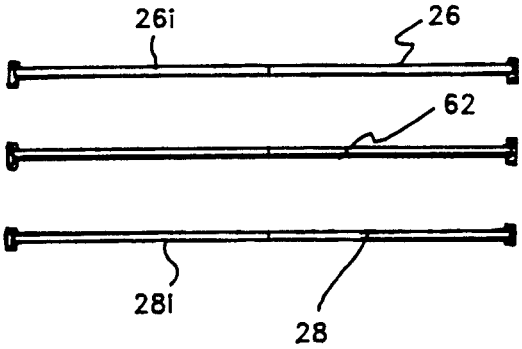
FIG. 12

WINDOW CORNICE AND METHOD FOR HANGING CURTAINS

This is a continuation application of copending patent application having application Ser. No. 07/426,640 filed Oct. 30, 1989, now U.S. Pat. No. 4,966,218. Copending application Ser. No. 07/426,640 is a continuation application of application Ser. No. 07/173,056, filed Mar. 25, 1988, now U.S. Pat. No. 4,922,600. Benefit of the earliest filing date of Mar. 25, 1988 is claimed.

FIELD OF THE INVENTION

The present invention is related generally to window cornices and the like. More particularly, the present invention relates to improvements in window cornices and to a method for hanging curtains that employs the improved window cornice of this invention.

DESCRIPTION OF THE PRIOR ART

A patentability investigation was conducted and the following United States patents were discovered: U.S. Pat. No. Des. 114,564 to Stratton; U.S. Pat. No. 2,739,644 to Brand; U.S. Pat. No. 2,823,743 to Isaac; U.S. Pat. No. 2,998,062 to Bixby; and U.S. Pat. No. 3,166,286 to Pfaff. None of these prior art patents teach or suggest the particular window cornice and method of this invention.

SUMMARY OF THE INVENTION

The present invention broadly accomplishes its desired objects by broadly providing a window cornice assembly that comprises a front member generally semi-circular or arcuate in vertical cross-section and having an upper edge and a lower edge. A rod is secured to the generally semi-circular front member, preferably to the upper edge thereof or to the lower edge thereof. The rod is for supporting at least one side member adaptable to be covered with a fabric. The rod comprises an intermediate rod section having a first off-set side and a second off-set side bound thereto, with the first off-set side and the second off-set side including ends being adaptable to mount to a wall member. The generally semi-circular front member more particularly secures slidably to the intermediate rod section of the rod such that the intermediate rod section extends longitudinally along the length of the generally semi-circular front member to longitudinally traverse the front member. A generally semi-circular or arcuate first side plate member is secured to and against the first off-set side, and a generally semi-circular or arcuate second side member is secured to and against the second off-set side. The first and second side members are adaptable to be covered with a fabric. Preferably, a fabric is disposed over the front member and is supported thereby. Preferably further, a fabric is additionally disposed over the generally semi-circular first side member, and the generally semi-circular second side member. A fabric encapsulates the front plate member and the two side plates.

The present invention further accomplishes its desired objects by also broadly providing a window cornice assembly comprising a front member arcuate in vertical cross-section and having an upper edge comprising a front upper channel and a lower edge comprising a front lower channel. The front member has a front generally smooth outer surface means for receiving and being covered by a fabric. The window cornice assembly also comprises at least one arcuate side member.

The arcuate side member comprises a side upper edge having a side upper channel and a side lower edge having a side lower channel. The arcuate side member further comprises a side generally smooth outer surface means for receiving and being covered by a fabric. A rod means is provided for supporting the front member and the arcuate side member. The rod means is secured to the front member and to the arcuate side member, and comprises an upper rod means for supporting the upper edge of the front member and the side upper edge of the arcuate side member, and a lower rod means for supporting the lower edge of the front member and the side lower edge of the arcuate side member. The upper rod means comprises an upper intermediate rod section means for engaging the front upper channel of the front member. The upper intermediate rod section means is disposed in the front upper channel of the front member such that the upper intermediate rod section means extends longitudinally along the upper edge of the front member. The upper rod means further comprises at least one upper off-set side means for engaging the side upper channel of the arcuate side member. The upper off-set side means is bound to the upper intermediate rod section means and is disposed in the side upper channel of the arcuate side member and includes at least one upper end means for being adaptable to mount to a wall member. The lower rod means comprises a lower intermediate rod section means for engaging the front lower channel of the front member. The lower intermediate rod section means is disposed in the front lower channel of the front member such that the lower intermediate rod section means extends longitudinally along the lower edge of the front member. The lower rod means further comprises at least one lower off-set side means for engaging the side lower channel of the arcuate side member. The lower off-set side means is bound to the lower intermediate rod section means and is disposed in the side lower channel of the arcuate side member and includes at least one lower end means for being adaptable to mount to a wall member. The front member additionally comprises a front inner surface spaced from the rod means and generally parallel to the front generally smooth outer surface means. The front inner surface is also spaced from the front upper channel and from the front lower channel. The front generally smooth outer surface means extends over the upper rod means (more specifically over the upper intermediate rod section means of the upper rod means) and over the lower rod means (more specifically over the lower intermediate rod section means of the lower rod means). The arcuate side member additionally comprises a side inner surface spaced from the rod means and generally parallel to the side generally smooth outer surface means. The side inner surface is also spaced from the side upper channel and from the side lower channel. The side generally smooth outer surface means extends over the upper rod means (more specifically over the upper off-set side means of the upper rod means) and over the lower rod means (more specifically over the lower off-set side means of the lower rod means).

The front member is initially formed to have the arcuate shape in vertical cross-section, and when secured to the upper rod means and to the lower rod means (more specifically to the upper intermediate rod section means and to the lower intermediate rod section means), the front member generally retains the arcuate shape in vertical cross-section. When a fabric is disposed over the front member, the front member continues to further generally retain the arcuate shape in vertical cross-section. Similarly, the arcuate member is initially formed to have an arcuate shape in a front elevational view when mounted to the rod means, and when secured to the upper rod means and to the lower rod means (more specifically to the upper off-set side means and to the lower off-set side means), the arcuate member generally retains the arcuate shape. When a fabric is disposed over the arcuate member, the arcuate member continues to further generally retain the arcuate shape. When a fabric is disposed over the front member and the arcuate side member, it has a hollow cylindrical configuration.

The present invention further accomplishes its desired objects by providing a method for hanging curtains and the like comprising the steps of:

(a) forming a generally semi-circular front plate having an upper edge defining an upper channel and a lower edge defining a lower channel;

(b) forming a generally semi-circular first side plate member having a first upper edge defining a first upper channel and a first lower edge defining a first lower channel;

(c) forming a generally semi-circular second side plate member having a second upper edge defining a second upper channel and a second lower edge defining a second lower channel;

(d) sliding a first section of a first curtain rod means through the first upper channel of the semi-circular first side plate and into the upper channel of the semi-circular front plate;

(e) sliding a second section of the first curtain rod means through the second upper channel of the semi-circular second side plate and into the upper channel of the semi-circular front plate;

(f) continuing to slide the first section and the second section of the first curtain rod means while in the upper channel of the semi-circular front plate until the first section slides into the second section such that the first section is slidably disposed within said second section;

(g) sliding a first section of a second curtain rod means through the first lower channel of the semi-circular first side plate and into the lower channel of the semi-circular front plate;

(h) sliding a second section of the second curtain rod means through the second lower channel of the semi-circular second side plate and into the lower channel of the semi-circular front plate;

(i) continuing to slide the first section and the second section of the second curtain rod means while in the lower channel of the semi-circular front plate until the first section of said curtain rod means slides into the second section of said second curtain rod means such that the first section is slidably disposed within said second section;

(j) forming a fabric means into a cylindrical hollow shape;

(k) sliding the formed cylindrical hollow fabric means of step (j) over the first side plate, the front plate and the second side plate such as to entirely surround the semi-circular plate, the first semi-circular side plate and the second semi-circular side plate including the sections of the upper and lower curtain rod means that are slidably disposed in said upper and lower channels respectively of said front plate and in said first upper channel and said first lower channel respectively of said first side plate and in said second upper channel and said second lower channel respectively of said second side plate; and (l) mounting the first and second curtain rod means to a wall member.

It is therefore an object of the present invention to provide a window cornice.

It is another object of the present invention to provide a method for hanging curtains which employs the use of the window cornice.

These, together with the various ancillary objects and features which will become apparent to those skilled in the art as the following description proceeds, are attained by this novel window cornice and method, a preferred embodiment being shown with reference to the accompanying drawings, by way of example only, wherein:

BRIEF DESCRIPTION OF THE DRAWINGS

FIG. 1 is a perspective view of the window cornice-curtain assembly;

FIG. 2 is a partial segmented side elevational view of the window cornice-curtain assembly of FIG. 1;

FIG. 3 is a partial perspective view of an end of a section of a curtain rod and a bracket;

FIG. 4 is a perspective view of the window cornice without the fabric;

FIG. 5 is a vertical sectional view taken in direction of the arrows and along the plane of line 5—5 in FIG. 4;

FIG. 6 is a perspective view of a side plate member;

FIG. 7 is a perspective view of a hollow cylindrical fabric;

FIG. 8 is a partial perspective view of the fabric of FIG. 7 disclosing the seam within the fabric;

FIG. 9 is a vertical sectional view taken in direction of the arrows and along the plane of line 9—9 in FIG. 5;

FIG. 10 is a partial side elevational view of one section of a curtain rod mating with and slidably passing into another section of the curtain rod;

FIG. 11 is a perspective view of the front plate member;

FIG. 12 is a front plan view of the three curtain rods that are employed with the window cornice-curtain assembly of this invention;

FIG. 13 is a partial perspective view of a hollow end of a section of a curtain rod;

FIG. 14 is a perspective view of the hollow cylindrical fabric passing over an end of a pair of curtain rods having secured thereto the front plate member and the pair of side plate members; and FIG. 15 is a partial vertical sectional view taken in direction of the arrows and along the plane of line 15—15 in FIG. 1.

DETAILED DESCRIPTION OF THE INVENTION

Referring in detail now to the drawings wherein similar parts of the invention are identified by like reference numerals, there is seen a window cornice-curtain assembly (see FIG. 1), generally illustrated as 10, comprising a window cornice, generally illustrated as 12, and a curtain assembly, generally illustrated as 14.

The window cornice 12 comprises an arcuate or semi-circular front plate 16 formed with an upper edge means 18 having an upper channel 20, and a lower edge means 22 having a lower channel 24. As best shown in FIG. 5, the front plate 16 is generally semi-circular or arcuate in vertical cross-section. An upper curtain rod 26 is slidably disposed through the upper channel 20 and a lower curtain rod 28 is slidably disposed through the lower channel 24. As best shown in FIG. 4, upper curtain rod 26 and lower curtain rod 28 respectively have off-set sides 26*s*—26*s* bound to an intermediate rod section 26*i*, and off-set sides 28*s*—28*s* bound to an intermediate rod section 28*i*. As further best shown in FIG. 4, the intermediate rod section 26*i* of the upper curtain rod 26 slidably secures to the upper edge means 18 of the semi-circular front plate 16 such that the intermediate rod section 26*i* extends along the upper edge means 18 and along the length of the front plate 16 to longitudinally traverse the front plate 16. Similarly, the intermediate rod section 28*i* of the lower curtain rod 28 slidably secures to the lower edge means 22 of the semi-circular front plate 16 such that the intermediate rod section 28*i* extends along the lower edge means 22 and along the length of the front plate 16 to longitudinally traverse the front plate 16. The off-set sides 26*s* and 28*s* of curtain rods 26 and 28 respectively mount to a wall 30, and are conventional curtain rods typically comprising a pair of sections. More specifically and by way of example only in referring to FIG. 10, upper curtain rod 26 comprises sections 32 and 34, with section 32 slidably disposed in section 34. Similarly, lower curtain rod 28 typically comprises a section 36 slidably disposed in a section 38. Each of the sections 32, 34, 36 and 38 have an open end with a lower aperture in close proximity to the open end such that the sections can engage a bracket. Referring to FIG. 3 by way of example only for more specificity, section 32 terminates in a hollow end 40 having a lower aperture 42 in close proximity thereto for mounting to a bracket 44 attached to the wall 30 by bolts 46—46. The bracket 44 includes an ear 48 protruding therefrom and having a lug 50 extending from the lower part thereof. The ear 48 slidably passes into the hollow end 40 such that lug 50 is removably disposed in lower aperture 42. The other sections 34, 36 and 38 are similarly formed such that each may mount to a bracket 44 mounted or attached on the wall 30 in order to hold the semi-circular plate 16 in a general horizontal (or other desired) position.

The window cornice 12 may additionally comprise a pair of arcuate or generally semi-circular side plates 52—52 respectively mounted to the rods 26 and 28 in an opposed relationship as shown in FIG. 4. The side plates 52—52 are adaptable to be covered with a fabric. Each side plate 52 is formed with an upper edge means 54 and a lower edge means 56. The upper edge means 54 and the lower edge means 56 include an upper side channel 58 and a lower side channel 61 respectively (see FIG. 6). Channel 58 slidably receives section 32 or 34 of the rod means 26 and channel 61 slidably receives section 36 or 38 of the rod means 28. As best shown in FIGS. 4, 5, 14 and 15, after the front member 16 and the side members 52—52 are secured to the rod 26 and/or 28, and the rod 26 and/or 28 is mounted to the wall 30, the front member 16 generally retains the arcuate or generally semi-circular shape in vertical cross-section and the side members 52—52 also retain the arcuate or generally semi-circular shape.

The window cornice 12 additionally includes a fabric 60 formed with a seam 82 and into a hollow cylindrical configuration, as illustrated in FIG. 7. The fabric 60 defines the outside or exterior of the window cornice 12. As illustrated in FIGS. 14 and 15, the combinations of the pair of side plates 52—52, the front plate 16, and the pair of curtain rod means 26 and 28 are surrounded by the fabric 60 by sliding the combinations through the hollow, cylindrical fabric 60. The ends of sections 32, 34, 36 and 38 are left exposed, protruding from the open ends of the cylindrical fabric 60 in order to respectively connect to four brackets 44 which have been secured to desired locations on the wall 30. As best shown in FIGS. 1, 2, 14 and 15, after the fabric 60 is disposed on or around the front member 16 and the side members 52—52, the front member 16 generally retains the arcuate or generally semi-circular shape in vertical cross-section and the side members 52—52 also retain the arcuate or generally semi-circular shape. A third curtain rod means 62 (see FIG. 12) is mounted to the wall member 30 in between rod means 26 and 28, as further illustrated in FIG. 4. A curtain 64 may be hung from this third curtain rod means 62 to obtain the window cornice-curtain assembly 10.

As best shown in FIG. 5, the front member 16 has a generally smooth outer surface 16*o* for receiving and being covered by the fabric 60. The front member 16 also has an inner surface 16*i* spaced from the rod 26 or 28, and spaced from the channels 20 and 24 (see FIG. 5). The inner surface 16*i* and the outer surface 16*o* are generally parallel with respect to each other, as further shown in FIG. 5. As further best shown in FIG. 5, when the front member 16 is mounted to rod 26 and/or 28, the outer surface 16*o* extends over the upper rod 26 (more specifically, over the top of the intermediate rod section 26*i*), and/or over the lower rod 28 (more specifically over the bottom of the intermediate rod section 28*i*).

As best shown in FIGS. 5, 9 and 15, the channels 20 and 24 are respectively formed in an upper longitudinal end 16*u* and in a lower longitudinal end 16*l* of the front member 16 and under the generally smooth outer surface 16*o*. The upper longitudinal end 16*u* has a longitudinal upper edge 16*ue* and the lower longitudinal end 16*l* has a longitudinal lower edge 16*le*. The channel 20 includes a back side 20*s*, a side 20*b*, and a front side 20*f*, all connected together. The back side 20*s* of the channel 20 connects to the longitudinal upper edge 16*ue* of the upper longitudinal end 16*u* of the front member 16 such that when the rod 26 is disposed in the channel 20 (more specifically when the intermediate rod section 26*i* is disposed in the channel 20), the back side 20*s* of the channel 20 is behind the rod 26, more specifically behind the intermediate rod section 26*i* (as shown in FIGS. 5 and 15). As depicted in FIG. 5, sides 20*s* and 20*f* are generally parallel to each other, with side 20*b* bound to sides 20*s* and 20*f* and generally normal or ninety degrees thereto. As best shown in FIGS. 5 and 15, the back side 20*s*, side 20*b*, and front side 20*f* are in contact with the rod 26 (more specifically with the intermediate rod section 26*i*) and form generally a general U-shaped channel in vertical cross section. Similarly, the channel 24 includes a back side 24*s*, a side 24*b*, and a front side 24*f*, all connected together. The back side 24*s* of the channel 24 connects to the longitudinal lower edge 16*le* of the lower longitudinal end 16*l* of the front member 16 such that when the rod 28 is disposed in the channel 24 (more specifically when the intermediate rod section 28*i* is disposed in the channel 24), the back side 24*s* of the channel 24 is behind the rod 28, more specifically behind the intermediate rod section 28*i* (as also shown in FIGS. 5 and 15). As depicted in FIG. 5, sides 24*s* and 24*f* are generally parallel to each other, with side 24*b* bound to sides 24*s* and 24*f* and generally normal or ninety degrees thereto. As best shown in FIGS. 5 and 15, the back side 24*s*, side 24*b*, and front side 24*f* are in contact with the rod 28 (more specifically with the intermediate rod section 28*i*) and form generally a general inverted U-shaped channel in vertical cross section. Thus, when the window cornice 12 is disposed in the generally horizontal position as depicted in FIGS. 1, 2, 4 and 15, the intermediate rod section 26*i* is disposed in channel 20 having a generally U-shape in vertical cross section, and the intermediate rod section 28*i* is disposed in channel 24 having a generally inverted U-shape in vertical cross section.

As best shown in FIGS. 4, 5 and 6, each of the side members 52—52 has a generally smooth outer surface 52*o* for receiving and being covered by the fabric 60. Each of the side members 52—52 also has an inner surface 52*i* spaced from the off-set sides 26*s*—26*s* or 28*s*—28*s*, and spaced from the channels 58 and 61 (see FIG. 6). The inner surface 52*i* and the outer surface 52*o* are generally parallel with respect to each other, as further shown in FIGS. 4, 5 and 6. As further best shown in FIGS. 4 and 5, when each side member 52 is mounted to off-set side 26*s* and/or 28*s*, the outer surface 52*o* extends over the upper rod 26 (more specifically, over the top of the off-set side 26*s*), and/or over the lower rod 28 (more specifically over the bottom of the off-set side 28*s*).

As further best shown in FIGS. 5, 9 and 15, the channels 58 and 61 are respectively formed in an upper longitudinal end 52*u* and in a lower longitudinal end 52*l* of the each of the side members 52 and under the generally smooth outer surface 52*o*. The upper longitudinal end 52*u* has a longitudinal upper edge 52*ue* and the lower longitudinal end 52*l* has a longitudinal lower edge 52*le*. The channel 58 includes a back side 58*s*, a side 58*b*, and a front side 58*f*, all connected together. The back side 58*s* of the channel 58 connects to the longitudinal upper edge 52*ue* of the upper longitudinal end 52*u* of the side member 52 such that when the rod 26 is disposed in the channel 58 (more specifically when the off-set side 26*s* is disposed in the channel 58), the back side 58*s* of the channel 58 is behind the rod 26, more specifically behind the off-set side 26*s* (as shown in FIGS. 4 and 5). As depicted in FIG. 6, sides 58*s* and 58*f* are generally parallel to each other, with side 58*b* bound to sides 58*s* and 58*f* and generally normal thereto. As best shown in FIG. 4 and FIG. 6, the back side 58*s*, side 58*b*, and front side 58*f* are in contact with the rod 26 (more specifically with the off-set side 26*s* as shown in FIG. 4) and form generally a general U-shaped channel in a vertical side view. Similarly, the channel 61 includes a back side 61*s*, a side 61*b*, and a front side 61*f*, all connected together. The back side 61*s* of the channel 61 connects to the longitudinal lower edge 52*le* of the lower longitudinal end 52*l* of the side member 52 such that when the rod 28 is disposed in the channel 61 (more specifically when the off-set side 28*s* is disposed in the channel 61), the back side 61*s* of the channel 61 is behind the rod 28, more specifically behind the off-set side 28*s* (as shown in FIGS. 4 and 5). As depicted in FIG. 6, sides 61*s* and 61*f* are generally parallel to each other, with side 61*b* bound to sides 61*s* and 61*f* and generally normal thereto. As best shown in FIG. 4 and FIG. 6, the back side 61*s*, side 61*b*, and front side 61*f* are in contact with rod 28 (more specifically with the off-set side 28*s* as shown in FIG. 4) and form generally a general inverted U-shaped channel in a vertical side view. Thus, when the window cornice 12 is disposed in the generally horizontal position as depicted in FIGS. 1, 2, 4 and 5, the off-set side 26*s* is disposed in the channel 58 having a generally U-shape in vertical side view, and the off-set side 28*s* is disposed in the channel 61 having a generally inverted U-shape in a vertical side view.

With continuing reference to the drawings for the method for hanging curtains employing the window cornice 12, the front plate 16 and the pair of side plates 52—52 are all initially formed in accordance with the previously mentioned shapes and features. As previously mentioned and as best shown in FIGS. 4, 5, 6, 11, and 14, the initially formed shape for the front member 16 is generally an arcuate or generally semi-circular shape in vertical cross-section; and the initially formed shape for the side members 52—52 is also the arcuate or generally semi-circular shape. Section 32 of curtain rod means 26 is slid through the upper channel 58 of one of the side plates 52 and into the upper channel 20 of the front plate 16. Section 34 of curtain rod means 26 is subsequently slid through the upper channel 58 of the other side plate 52 and into the upper channel 20 of the front plate 16. Sections 32 and 34 are continually slid while in upper channels 58 and 58 of the two side plates 52—52 respectively and while in the upper channel 20 of the front plate 16 until the section 32 slides into the section 34 (see FIG. 9). Similarly, section 36 of curtain rod means 28 is slid through the lower channel 61 of the side plate 52 having section 32 in its upper channel 58, and into the lower channel 24 of the front plate 16. Section 38 of rod means 28 is subsequently slid through the lower channel 61 of side plate 52 having section 34 in its upper channel 58, and into the lower channel 24 of the front plate 16. Sections 36 and 38 are continually slid while in the lower channels 61 and 61 of side plates 52—52 respectively and while in the lower channel 24 of the front plate 16 until section 36 slides into section 38 (see FIG. 9). Thereafter, fabric 60 is formed into the hollow cylindrical shape of FIG. 7, and as illustrated in FIG. 14, the formed hollow cylindrical fabric 60 is slid over one of the side plates 52, the front plate 16, and the other side plate 52 such as to entirely surround all of the same including the respective sections of the curtain rod means 26 and 28 in the upper and lower channels respectively of the front plate 16 and the pair of side plates 52—52. The hollow ends 40 of sections 32, 34, and 38 are exposed in order to engage four brackets 44—44—44—44 which have been disposed as desired on the wall 30. The third curtain rod means 62 may now be mounted to a pair of brackets 44—44 that have been respectively positioned between the two pairs of outside brackets 44—44 and 44—44 such that rod means 62 is in between the rod means 26 and 28. The curtain 64 can now be hung from the third curtain rod means 62 to produce the window cornice-curtain assembly 10 of FIG. 1. It is to be understood as would be readily apparent that the third curtain rod means 62-curtain 64 combination can be secured to wall 30 initially, followed by the mounting of the window cornice 12 such as to cover the top of the curtain 64 including the third curtain rod means 62.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A window cornice assembly comprising a rod means for supporting at least one arcuate side member, said rod means comprising an intermediate rod section and at least one off-set side bound to said intermediate rod section and with an end being adaptable to mount to a wall member; and at least one arcuate side member having a side inner surface, said at least one arcuate side member being distinct from and secured to said off-set side of said rod means with said side inner surface spaced from said off-set side of said rod means; and said arcuate side member comprises at least one channel, and a generally smooth outer arcuate surface means for receiving and being covered by a fabric; and said off-set side is disposed in said channel and said generally smooth outer arcuate surface means extends over said off-set side; and a fabric disposed over the at least one arcuate side member and supported thereby.

2. The window cornice assembly of claim 1 wherein said generally smooth outer arcuate surface means and said side inner surface are generally parallel.

3. The window cornice assembly of claim 1 wherein said arcuate side member additionally comprises a longitudinal edge, and said channel comprises a first channel side secured to said longitudinal edge and in contact with said off-set side and disposed behind said off-set side.

4. The window cornice assembly of claim 1 wherein said channel has a generally U-shape.

5. The window cornice assembly of claim 1 wherein said fabric is disposed over said off-set side such as to entirely surround said off-set side.

6. The window cornice assembly of claim 5 wherein said fabric has a hollow cylindrical configuration.

7. The window cornice assembly of claim 1 additionally comprising a front member generally arcuate in vertical cross section and secured to said intermediate rod section of the rod means such that the intermediate rod section extends longitudinally along the front member; said front member comprises a front generally smooth outer surface means for receiving and being covered by said fabric, said fabric being disposed over the front generally smooth outer surface means; and said front member further comprises a front inner surface spaced from the intermediate rod section of the rod means.

8. The window cornice assembly of claim 7 wherein said front member additionally comprises at least one front channel, said intermediate rod section being disposed in said front channel.

9. The window cornice assembly of claim 8 wherein said front channel is generally U-shape in vertical cross-section, and said front inner surface being spaced from said front channel.

10. The window cornice assembly of claim 9 wherein said fabric has a hollow cylindrical configuration.

11. A window cornice assembly comprising a front plate member generally semi-circular in vertical cross section and having an upper edge and a lower edge; a curtain rod means for supporting at least one generally semi-circular side plate member adaptable to be covered with a fabric, said curtain rod means having an intermediate rod section that is distinct from and secured to said front plate member such that the intermediate rod section extends longitudinally along the front plate member and comprising a first off-set side and a second off-set side both bound to said intermediate rod section with said first off-set side and said second off-set side including ends being adaptable to mount to a wall member; a first generally semi-circular side plate member adaptable to be covered with a fabric, said first generally semi-circular side plate member being secured against said first off-set side; and a second generally semi-circular side plate member adaptable to be covered with a fabric, said second generally semi-circular side plate member being secured against said second off-set side.

12. The window cornice assembly of claim 11 additionally comprising a fabric disposed over the front plate member and supported thereby.

13. The window cornice assembly of claim 11 additionally comprising a fabric disposed over the first generally semi-circular side plate member and over the second generally semi-circular side plate member.

14. The window cornice assembly of claim 11 additionally comprising a fabric disposed over the front plate member and supported thereby, said fabric being additionally disposed over said first generally semi-circular side plate member and over said second generally semi-circular side plate member.

15. A window cornice assembly comprising a front plate member having an upper edge and a lower edge, said front plate member being generally semi-circular in vertical cross-section; an upper rod means for supporting the upper edge of the front plate member, said upper rod means having an upper intermediate section slidably secured to said upper edge of the front plate member; a lower rod means for supporting the lower edge of the front plate member, said lower rod means having a lower intermediate section slidably secured to said lower edge of the front plate member, said upper rod means and said lower rod means having off-set sides with ends being adaptable to mount to a wall member; a first generally semi-circular side plate member adaptable to be covered with a fabric and having a first upper edge and a first lower edge, said lower rod means is slidably secured to said first lower edge of said first generally semi-circular side plate member and said upper rod means is slidably secured to said first upper edge of said first generally semi-circular side plate member; and a fabric disposed over the front plate member and supported thereby, said fabric being additionally disposed over said first generally semi-circular side plate member.

16. The window cornice assembly of claim 15 additionally comprising a second generally semi-circular side plate member adaptable to be covered with said fabric and having a second upper edge and a second lower edge, said lower rod means is slidably secured to said second lower edge of said second generally semi-circular plate side member and said upper rod means is slidably secured to said second upper edge of said second generally semi-circular side plate member, said fabric being additionally disposed over said second generally semi-circular side plate member.

17. A window cornice assembly comprising a front plate member generally semi-circular in vertical cross-section and having an upper edge and a lower edge; a curtain rod means for supporting at least one side plate member adaptable to be covered with a fabric, said curtain rod means having an intermediate rod section that is distinct from and secured to said generally semi-circular front plate member such that the intermediate rod section extends longitudinally along the generally semi-circular front plate member and comprising at least one off-set side bound to said intermediate rod section and with an end being adaptable to mount to a wall member; and at least one side plate member adaptable to be covered with a fabric, said at least one side plate member being distinct from and secured to said at least one off-set side of said curtain rod means.

18. The window cornice assembly of claim 17 additionally comprising a fabric disposed over said at least one side plate member and supported thereby.

19. The window cornice assembly of claim 18 wherein said fabric is disposed over said generally semi-circular front plate member.

20. The window cornice assembly of claim 17 additionally comprising a fabric disposed over said generally semi-circular front plate member and supported thereby.

21. A window cornice assembly comprising in combination a curtain rod means for supporting at least one arcuate side plate member adaptable to be covered with a fabric, said curtain rod means having an intermediate rod section and at least one off-set side bound to said intermediate rod section and with an end being adaptable to mount to a wall member; at least one arcuate side plate member adaptable to be covered with a fabric, said at least one arcuate side plate member being distinct from and secured against said at least one off-set side of said curtain rod means; and a fabric disposed over the at least one arcuate side plate member and off-set side and supported thereby.

22. The window cornice assembly of claim 21 additionally comprising a front plate member generally semi-circular in vertical cross section and secured to said intermediate rod section of said first rod.

23. A window cornice assembly comprising a front plate member arcuate in vertical cross-section and having an upper edge and a lower edge; a curtain rod means for supporting at least one arcuate side plate member adaptable to be covered with a fabric, said curtain rod means having an intermediate rod section that is distinct from and secured to said front plate member such that the intermediate rod section extends longitudinally along the front plate member and comprising a first off-set side and a second off-set side both bound to said intermediate rod section with said first off-set side and said second off-set side including ends being adaptable to mount to a wall member; a first arcuate side plate member adaptable to be covered with a fabric, said first arcuate side plate member being secured against said first off-set side; and a second arcuate side plate member adaptable to be covered with a fabric, said second arcuate side plate member being secured against said second off-set side.

24. The window cornice assembly of claim 23 additionally comprising a fabric disposed over the front plate member and supported thereby.

25. The window cornice assembly of claim 23 additionally comprising a fabric disposed over the first arcuate side plate member and over the second arcuate side plate member.

26. The window cornice assembly of claim 23 additionally comprising a fabric disposed over the front plate member and supported thereby, said fabric being additionally disposed over said first arcuate side plate member and over said second arcuate side plate member.

27. The window cornice assembly of claim 11 additionally comprising in combination therewith a rod adaptable to be mounted to said wall member for hanging a curtain therefrom.

28. The window cornice assembly of claim 16 additionally comprising in combination therewith a rod adaptable to be mounted to said wall member for hanging a curtain therefrom.

29. The window cornice assembly of claim 17 additionally comprising in combination therewith a rod adaptable to be mounted to said wall member for hanging a curtain therefrom.

30. The window cornice assembly of claim 23 additionally comprising in combination therewith a rod adaptable to be mounted to said wall member for hanging a curtain therefrom.

31. The window cornice assembly of claim 10 wherein said front member being initially formed to comprise an arcuate shape in vertical cross-section; and said intermediate rod section being secured to said front member such that said front member generally retains said initially formed arcuate shape in vertical cross-section; and said at least one arcuate side member being initially formed to comprise an arcuate shape, and secured to said off-set side of said rod means such that said arcuate side member generally retains said initially formed arcuate shape; and said fabric being disposed over the front member and over the arcuate side member such that said front member generally retains said initially formed arcuate shape in vertical cross-section and said arcuate member generally retains said initially formed arcuate shape.

32. The window cornice assembly of claim 27 additionally comprising a curtain secured to said rod.

33. The window cornice assembly of claim 28 additionally comprising a curtain secured to said rod.

34. The window cornice assembly of claim 29 additionally comprising a curtain secured to said rod.

35. The window cornice assembly of claim 30 additionally comprising a curtain secured to said rod.

36. The window cornice assembly of claim 21 wherein said arcuate side plate member comprises at least one channel, and a generally smooth outer arcuate surface means for receiving and being covered by said fabric, and an inner surface spaced from the off-set side of said curtain rod means and from the channel.

37. The window cornice assembly of claim 36 wherein said off-set side is disposed in said channel, and said generally smooth outer arcuate surface means extends over said off-set side.

38. The window cornice assembly of claim 37 wherein said generally smooth outer arcuate surface means and said inner surface are generally parallel.

39. The window cornice assembly of claim 37 wherein said arcuate side plate member additionally comprises a longitudinal edge and said channel comprises a first channel side secured to said longitudinal edge and in contact with said off-set side of said curtain rod means.

40. The window cornice assembly of claim 39 wherein said channel additionally comprises a second channel side connected to said first channel side and in contact with said off-set side of said curtain rod means.

41. The window cornice assembly of claim 39 wherein said first channel side is disposed behind said off-set side of said curtain rod means.

42. The window cornice assembly of claim 36 wherein said channel has a generally U-shape.

43. The window cornice assembly of claim 36 wherein said channel has a generally inverted U-shape.

44. The window cornice assembly of claim 37 additionally comprising a front plate member generally arcuate in vertical cross section and secured to said intermediate rod section of the curtain rod means such that the intermediate rod section extends longitudinally along the front plate member; said front plate member comprises a front generally smooth outer surface means for receiving and being covered by said fabric, said fabric being disposed over the front generally smooth outer surface means; and said front plate member further comprises a front inner surface spaced from the intermediate rod section of the curtain rod means.

45. The window cornice assembly of claim 43 additionally comprising a front plate member generally arcuate in vertical cross section and secured to said intermediate rod section of the curtain rod means such that the intermediate rod section extends longitudinally along the front plate member; said front plate member comprises a front generally smooth outer surface means for receiving and being covered by said fabric, said fabric being disposed over the front generally smooth outer surface means; and said front plate member further comprises a front inner surface spaced from the intermediate rod section of the curtain rod means.

46. The window cornice assembly of claim 44 wherein said front plate member additionally comprises at least one front channel, said intermediate rod section being disposed in said front channel.

47. The window cornice assembly of claim 46 wherein said front channel is generally U-shape in vertical cross-section, and said front inner surface being spaced from said front channel.

48. The window cornice assembly of claim 45 wherein said front plate member additionally comprises at least one front channel, said intermediate rod section being disposed in said front channel.

49. The window cornice assembly of claim 48 wherein said front channel is generally U-shape in vertical cross-section, and said front inner surface being spaced from said front channel.

50. The window cornice assembly of claim 49 wherein said fabric has a hollow cylindrical configuration.

51. The window cornice assembly of claim 23 wherein said first arcuate side plate member comprises at least one first channel, a first generally smooth outer arcuate surface means for receiving and being covered by a fabric, and a first inner surface spaced from the first off-set side of said curtain rod means and from the first channel.

52. The window cornice assembly of claim 51 wherein said first off-set side is disposed in said first channel, and said first generally smooth outer arcuate surface means extends over said first off-set side of said curtain rod means.

53. The window cornice assembly of claim 52 wherein said first generally smooth outer arcuate surface means and said first inner surface are generally parallel.

54. The window cornice assembly of claim 51 wherein said first arcuate side plate member additionally comprises a first longitudinal edge and said first channel comprises a first channel side secured to said first longitudinal edge and in contact with said first off-set side of said curtain rod means.

55. The window cornice assembly claim 54 wherein said first channel additionally comprises a second channel side connected to said first channel side and in contact with said first off-set side of said curtain rod means.

56. The window cornice assembly of claim 54 wherein said first channel side is disposed behind said first off-set side of said curtain rod means.

57. The window cornice assembly of claim 52 wherein said front plate member comprises at least one front channel, a front generally smooth outer surface means for receiving and being covered by a fabric, and a front inner surface spaced from the intermediate rod section of said curtain rod means.

58. The window cornice assembly of claim 57 wherein said intermediate rod section is disposed in said front channel, and said front generally smooth outer surface means extends over said intermediate rod section.

59. The window cornice assembly of claim 57 additionally comprising a fabric disposed over the front generally smooth outer surface means of the front plate member, and over the first generally smooth outer arcuate surface means of the first arcuate side plate member.

60. The window cornice assembly of claim 59 wherein said fabric has a hollow cylindrical configuration.

61. The window cornice assembly of claim 59 wherein said first channel has a generally inverted U-shape.

62. The window cornice assembly of claim 61 wherein said front channel is generally inverted U-shape in vertical cross-section.

63. A window cornice assembly comprising a rod means for supporting at least one arcuate side member, said rod means comprising an intermediate rod section and at least one off-set side bound to said intermediate rod section and with an end being adaptable to mount to a wall member; and at least one arcuate side member having a side inner surface, said at least one arcuate side member being distinct from and secured to said off-set side of said rod means with said side inner surface spaced from said off-set side of said rod means; and a fabric disposed over the at least one arcuate side member and off-set side and supported thereby.

64. The window cornice assembly of claim 63 wherein said arcuate side member comprises at least one channel, and a generally smooth outer arcuate surface means for receiving and being covered by said fabric; and said off-set side is disposed in said channel and said generally smooth outer arcuate surface means extends over said off-set side.

65. The window cornice assembly of claim 64 wherein said generally smooth outer arcuate surface means and said side inner surface are generally parallel.

66. The window cornice assembly of claim 64 wherein said arcuate side member additionally comprises a longitudinal edge, and said channel comprises a first channel side secured to said longitudinal edge and in contact with said off-set side and disposed behind said off-set side.

67. The window cornice assembly of claim 64 wherein said channel has a generally U-shape.

68. The window cornice assembly of claim 64 wherein said fabric has a hollow cylindrical configuration.

69. The window cornice assembly of claim 64 additionally comprising a front member generally arcuate in vertical cross section and secured to said intermediate rod section of the rod means such that the intermediate rod section extends longitudinally along the front member; said front member comprises a front generally smooth outer surface means for receiving and being covered by said fabric, said fabric being disposed over the front generally smooth outer surface means; and said front member further comprises a front inner surface spaced from the intermediate rod section of the rod means.

70. The window cornice assembly of claim 69 wherein said front member additionally comprises at least one front channel, said intermediate rod section being disposed in said front channel.

71. The window cornice assembly of claim 70 wherein said front channel is generally U-shape in vertical cross-section, and said front inner surface being spaced from said front channel.

72. The window cornice assembly of claim 71 wherein said fabric has a hollow cylindrical configuration.

73. The window cornice assembly of claim 64 wherein said at least one arcuate side member being initially formed to comprise an arcuate shape, and secured to said off-set side of said rod means such that said arcuate side member generally retains said initially formed arcuate shape; and said fabric being disposed over the arcuate side member and supported thereby such that said arcuate side member generally retains said initially formed arcuate shape.

74. The window cornice assembly of claim 72 wherein said front member being initially formed to comprise an arcuate shape in vertical cross-section; and said intermediate rod section being secured to said front member such that said front member generally retains said initially formed arcuate shape in vertical cross-section; and said at least one arcuate side member being initially formed to comprise an arcuate shape, and secured to said off-set side of said rod means such that said arcuate side member generally retains said initially formed arcuate shape; and said fabric being disposed over the front member and over the arcuate side member such that said front member generally retains said initially formed arcuate shape in vertical cross-section and said arcuate member generally retains said initially formed arcuate shape.

75. A window cornice assembly comprising a front member initially formed to comprise an arcuate shape in vertical cross-section and having an upper edge and a lower edge; a rod means for supporting at least one arcuate side member, said rod means comprising an intermediate rod section that is distinct from and secured to said front member such that said front member generally retains said initially formed arcuate shape in vertical cross-section and said intermediate rod section extends longitudinally along the front member, and said rod means further comprising at least one off-set side bound to the intermediate rod section and with an end being adaptable to mount to a wall member; and at least one arcuate side member initially formed to comprise an arcuate shape, and secured to said off-set side of said rod means such that said arcuate side member generally retains said initially formed arcuate shape.

76. The window cornice assembly of claim 75 wherein said arcuate side member comprises at least one channel, a generally smooth outer arcuate surface means for receiving and being covered by a fabric, and an inner surface spaced from the off-set side of said rod means and from the channel.

77. The window cornice assembly of claim 76 wherein said off-set side is disposed is said channel, and said generally smooth outer arcuate surface means extends over said off-set side of said rod means.

78. The window cornice assembly of claim 77 wherein said generally smooth outer arcuate surface means and said inner surface are generally parallel.

79. The window cornice assembly of claim 76 wherein said arcuate side member additionally comprises a longitudinal edge and said channel comprises a first channel side secured to said longitudinal edge and in contact with said off-set side of said rod means.

80. The window cornice assembly claim 79 wherein said channel additionally comprises a second channel side connected to said first channel side and in contact with said off-set side of said rod means.

81. The window cornice assembly of claim 79 wherein said first channel side is disposed behind said off-set side of said rod means.

82. The window cornice assembly of claim 77 wherein said front member comprises at least one front channel, a front generally smooth outer surface means for receiving and being covered by a fabric, and a front inner surface spaced from the intermediate rod section of said rod means.

83. The window cornice assembly of claim 82 wherein said intermediate rod section is disposed in said front channel, and said front generally smooth outer surface means extends over said intermediate rod section.

84. The window cornice assembly of claim 82 additionally comprising a fabric disposed over the front generally smooth outer surface means of the front member, and over the generally smooth outer arcuate surface means of the arcuate side member such that said front member generally retains said initially formed arcuate shape in vertical cross-section and said arcuate side member generally retains said initially formed arcuate shape.

85. The window cornice assembly of claim 84 wherein said fabric has a hollow cylindrical configuration.

86. The window cornice assembly of claim 84 wherein said channel has a generally inverted U-shape.

87. The window cornice assembly of claim 86 wherein said front channel is generally inverted U-shape in vertical cross-section.

88. A window cornice assembly comprising a front member arcuate in vertical cross-section and having an upper edge comprising a front upper channel and a lower edge comprising a front lower channel, said front member comprising a front generally smooth outer surface means for receiving and being covered by a fabric;

at least one arcuate side member, said arcuate side member comprising a side upper edge comprising a side upper channel and a side lower edge comprising a side lower channel, said arcuate side member further comprising a side generally smooth outer surface means for receiving and being covered by a fabric;

a rod means for supporting the front member and the arcuate side member, said rod means being secured to said front member and to said arcuate side member, and comprising an upper rod means for supporting the upper edge of the front member and the side upper edge of the arcuate side member, and a lower rod means for supporting the lower edge of the front member and the side lower edge of the arcuate side member; and said upper rod means comprises an upper intermediate rod section means for engaging the front upper channel of said front member, and said upper intermediate rod section means being disposed in the front upper channel of said front member such that said upper intermediate rod section means extends longitudinally along said upper edge of said front member, and said upper rod means further comprises at least one upper off-set side means for engaging the side upper channel of said arcuate side member, said upper off-set side means being bound to said upper intermediate rod section means and disposed in the side upper channel of said arcuate side member and includes at least one upper end means for being adaptable to mount to a wall member; and said lower rod means comprises a lower intermediate rod section means for engaging the front lower channel of said front member, and said lower intermediate rod section means being disposed in the front lower channel of said front member such that said lower intermediate rod section means extends longitudinally along said lower edge of said front member, and said lower rod means further comprises at least one lower off-set side means for engaging the side lower channel of said arcuate side member, said lower off-set side means being bound to said lower intermediate rod section means and disposed in the side lower channel of said arcuate side member and includes at least one lower end means for being adaptable to mount to a wall member.

89. The window cornice assembly of claim 88 wherein said front member additionally comprises a front inner surface spaced from said rod means, and said arcuate side member additionally comprises a side inner surface spaced from said rod means.

90. The window cornice assembly of claim 89 wherein said upper edge of said front member comprises an upper longitudinal edge, and said front upper channel comprises a front upper channel side connected to said upper longitudinal edge and disposed behind said upper intermediate rod section means.

91. The window cornice assembly of claim 90 wherein said lower edge of said front member comprises a lower longitudinal edge, and said front lower channel comprises a front lower channel side connected to said lower longitudinal edge and disposed behind said lower intermediate rod section means.

92. The window cornice assembly of claim 91 wherein said side upper edge of said arcuate side member comprises a side upper longitudinal edge; and said side upper channel comprises a side upper channel side connected to said side upper longitudinal edge.

93. The window cornice assembly of claim 92 wherein said side lower edge of said arcuate side member comprises a side lower longitudinal edge; and said side lower channel comprises a side lower channel side connected to said side lower longitudinal edge.

94. The window cornice assembly of claim 93 wherein said side upper channel side is disposed behind said upper off-set side means; and said lower channel side is disposed behind said lower off-set side means; and said side generally smooth outer surface means of said arcuate side member and said side inner surface of said arcuate side member are generally parallel with respect to each other; and said front generally smooth outer surface means of said front member and said front inner surface of said front member are generally parallel with respect to each other.

95. The window cornice assembly of claim 93 additionally comprising a fabric disposed over the front generally smooth outer surface means of the front member and over said side generally smooth outer surface means of the arcuate side member.

96. The window cornice assembly of claim 95 wherein said fabric has a hollow cylindrical configuration.

97. The window cornice assembly of claim 94 additionally comprising a fabric disposed over the front generally smooth outer surface means of the front member and over said side generally smooth outer surface means of the arcuate side member.

98. The window cornice assembly of claim 97 wherein said fabric has a hollow cylindrical configuration; and said front generally smooth outer surface means extends over said upper intermediate rod section means and over said lower intermediate rod section means; and said side generally smooth outer surface means extends over said upper off-set side means and over said lower off-set side means.

99. The window cornice assembly of claim 1 wherein said at least one arcuate side member being initially formed to comprise an arcuate shape, and secured to said off-set side of said rod means such that said arcuate side member generally retains said initially formed arcuate shape; and said fabric being disposed over the arcuate side member and supported thereby such that said arcuate side member generally retains said initially formed arcuate shape.

* * * * *